United States Patent [19]

Kawamura

[11] Patent Number: 4,972,810

[45] Date of Patent: Nov. 27, 1990

[54] ELECTROMAGNETIC FORCE VALVE DRIVING APPARATUS

[75] Inventor: Hideo Kawamura, Samukawa, Japan

[73] Assignee: Isuzu Motors Limited, Tokyo, Japan

[21] Appl. No.: 457,142

[22] Filed: Dec. 26, 1989

[30] Foreign Application Priority Data

Dec. 29, 1988 [JP] Japan ..... 63-333440

[51] Int. Cl.[5] ..... F01L 9/04

[52] U.S. Cl. ..... 123/90.11; 251/129.01; 361/156

[58] Field of Search ..... 123/90.11; 251/65, 129.01; 361/154, 155, 156

[56] References Cited

U.S. PATENT DOCUMENTS

| | | | |
|---|---|---|---|
| 3,682,152 | 8/1972 | Muller-Berner | 123/90.11 |
| 4,323,944 | 4/1982 | Hill | 361/156 |
| 4,350,319 | 9/1982 | Kawata et al. | 251/65 |
| 4,454,558 | 6/1984 | Huddart | 361/156 |
| 4,544,986 | 10/1985 | Buchl | 123/90.11 |
| 4,614,170 | 9/1986 | Pischinger et al. | 123/90.11 |
| 4,700,684 | 10/1987 | Pischinger et al. | 123/90.11 |
| 4,719,882 | 1/1988 | Kreuter | 123/90.11 |
| 4,779,582 | 10/1988 | Lequesne | 123/90.11 |
| 4,823,825 | 4/1989 | Buchl | 123/90.11 |
| 4,829,947 | 5/1989 | Lequesne | 123/90.11 |

FOREIGN PATENT DOCUMENTS

| | | | |
|---|---|---|---|
| 3323400 | 1/1984 | Fed. Rep. of Germany . | |
| 3546513 | 2/1987 | Fed. Rep. of Germany | 123/90.11 |
| 183805 | 10/1983 | Japan . | |
| 200872 | 11/1983 | Japan | 251/129.01 |
| 76713 | 4/1986 | Japan . | |
| 83570 | 4/1987 | Japan | 251/129.01 |
| 34387 | 2/1988 | Japan | 251/129.01 |
| 1249205 | 10/1971 | United Kingdom . | |

*Primary Examiner*—Charles J. Myhre
*Assistant Examiner*—Weilun Lo
*Attorney, Agent, or Firm*—Staas & Halsey

[57] ABSTRACT

A valve driving apparatus includes a permanent magnet connectd to a suction/exhaust valve and an electromagnet secured to the engine body, and is adapted to drive the valve by attractive and repulsive electromagnetic forces which act between the electromagnet and the permanent magnet. The electromagnet ordinarily is supplied with electric power from a battery. However, if a strong electromagnetic force is to be applied to the suction/exhaust valve, the electromagnet is supplied with charge from a capacitor charged beforehand by the battery. Control is exercised to increase or decrease, in dependence upon the engine rpm or load, the amount by which the electromagnet is energized by the battery and the amount by which the capacitor is charged.

5 Claims, 2 Drawing Sheets

ELECTROMAGNETIC FORCE VALVE DRIVING APPARATUS

BACKGROUND OF THE INVENTION

1. Field of the Invention

This invention relates to an electromagnetic force valve driving apparatus which opens and closes the suction/exhaust valve of an engine by an electromagnetic force produced by an electromagnet.

2. Description of the Prior Art

In an ordinary engine, a valve is controlled to open and close so that a cylinder may perform a suction/exhaust operation.

In one example of a drive apparatus for opening and closing such a suction/exhaust valve, a cam shaft, which is obtained by disposing cams for suction and exhaust on one shaft, is provided on the upper portion of the engine or on one side face thereof. A crankshaft, which is the rotary shaft of the engine, and the cam shaft are connected by rotary transmission means such as a belt, and the cam shaft is driven rotatively in synchronism with the rotational phase of the engine. The axial end face of the valve is pushed by the cam face of the cam shaft via a link mechanism such as a rocker arm or pushing rod. The suction/exhaust valve normally is held in the closed state by a spring and its axial end face is opened by being pushed.

In another example of a drive apparatus for opening and closing a suction/exhaust valve, a suction cam shaft having a suction cam and an exhaust cam shaft having an exhaust cam are disposed on the upper portion of an engine, the cam face of the suction cam shaft pushes the axial end face of the suction valve directly, and the cam face of the exhaust cam shaft pushes the axial end face of the exhaust valve directly, thereby opening the suction-/exhaust valve.

This conventional drive apparatus for opening and closing the suction/exhaust valve results in a large-size engine because the cam shaft and link mechanism must be added onto the engine. Furthermore, since the cam shaft and link mechanism are driven by the output shaft of the engine, some of the engine output is consumed by frictional resistance when the cam shaft and link mechanism are driven. This diminishes the effective output of the engine.

Further, the actuation timing of the suction/discharge valve cannot be altered during engine operation. Since the valve actuation timing is adjusted so as to attain high efficiency in a case where the engine is running at a prescribed rpm, engine efficiency declines when it is running at an rpm different from the prescribed rpm.

In order to solve the foregoing problems, an apparatus for driving a suction/exhaust valve to open and close the same by electromagnetic force from an electromagnet, without relying upon a cam shaft, has been disclosed in Japanese Patent Application Laid-Open (KOKAI) Nos. 58-183805 and 61-76713.

However, these two publications do not disclose current control for suitably regulating electromagnetic force to the required magnitude in cases where a large current must be supplied to the electromagnet, as when the suction/exhaust valve starts to be moved in the opening direction and when it is decelerated just before being seated. Consequently, it is not possible to generate a sufficiently large electromagnetic force needed to smoothly start and decelerate the valve.

SUMMARY OF THE INVENTION

The present invention has been devised for the purpose of controlling a suction/exhaust valve by electromagnetic force so that the valve may be opened and closed smoothly.

In the valve driving apparatus according to the present invention, a permanent magnet connected to a suction/exhaust valve is attracted to or repelled from a fixed electromagnet opposing the permanent magnet, thereby controlling the opening and closing of the suction/exhaust valve. When it is necessary for a strong repulsive force to be applied to the suction/exhaust valve at the start of the valve opening operation and immediately before valve seating, the fixed electromagnet is supplied with electric power resulting from a charged capacitor having a low internal resistance, whereby the strong repulsive force is caused to-act upon the suction/exhaust valve.

Features and advantages of the present invention will be apparent from the following description taken in conjunction with the accompanying drawings.

DESCRIPTION OF THE PREFERRED EMBODIMENT

An embodiment of the present invention will now be described in detail with reference to the drawings.

Figure 1:
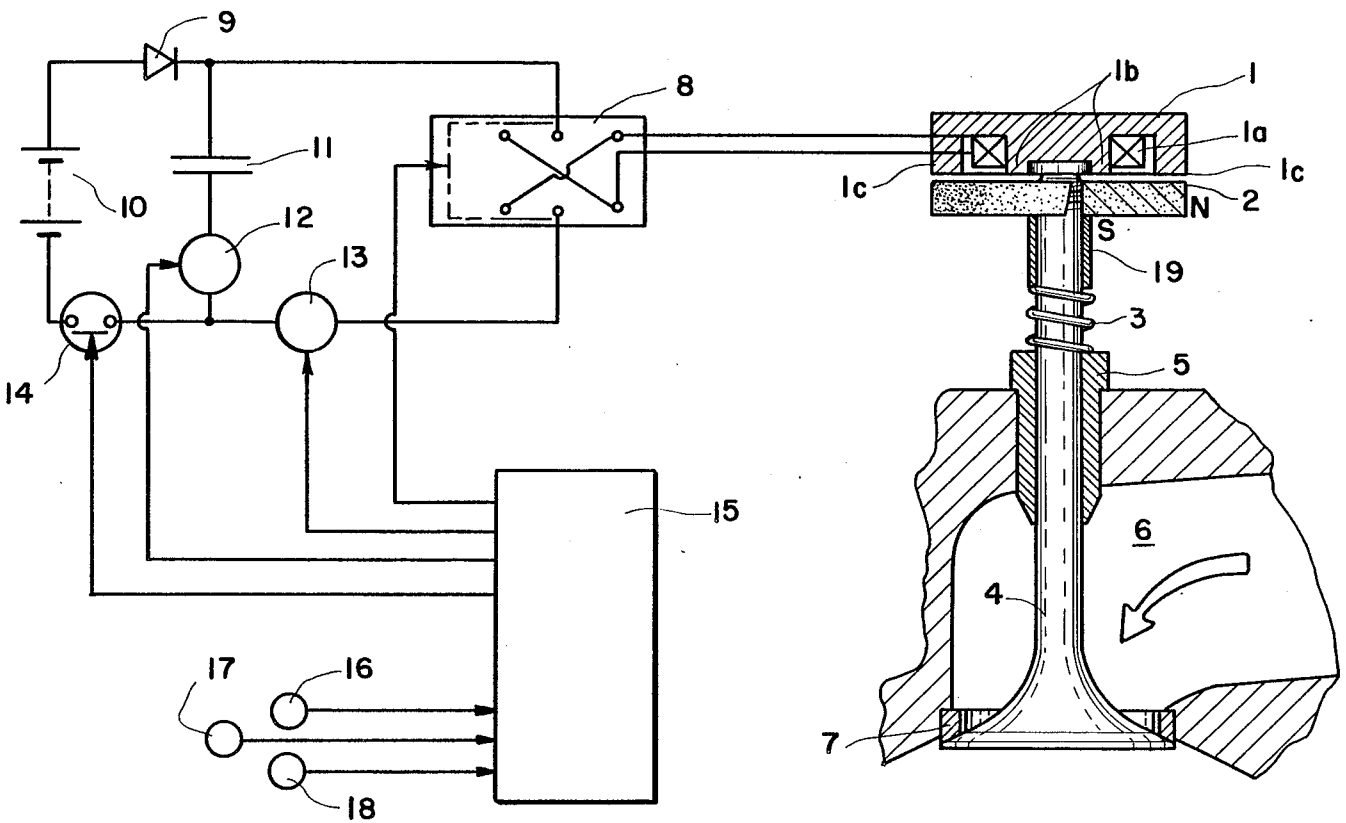
FIG. 1 is a block diagram illustrating an embodiment of the present invention.

FIG. 1 is a block diagram illustrating a driving apparatus according to the present invention.

Numeral 4 denotes a suction valve consisting of a light-weight, heat-resistant and high-strength ceramic. It is also permissible to form the suction valve 4 from a metal material which exhibits excellent heat resistance and high strength.

The suction valve 4 is axially supported by a valve guide 5 so as to be free to move in the axial direction, and has an axial end portion on the periphery of which an annular permanent magnet 2 is affixed.

The permanent magnet 2 is magnetized so that its inner circumferential side is an S pole and its outer circumferential side an N pole. A collar 19 and a spring 3 are interposed between the permanent magnet 2 and the valve guide 5. The beveled portion of the permanent magnet 2 is in intimate contact with a valve seat 7 to close the suction port at the terminus of an intake conduit 6.

Disposed above the permanent magnet 2 is an electromagnet 1 having an internal magnetic pole **1*b* opposing the S pole on the inner circumferential side of the permanent magnet, and an external magnetic pole 1*c* opposing the N pole on the outer circumferential side of the permanent magnet. A coil 1*a* which, when excited, produces the inner pole 1*b* and the outer pole 1*c*, is wound on the electromagnet 1**.

The coil **1*a* is connected to a changeover switch 8. In response to an externally applied signal, the changeover switch 8** changes over the energizing direction of electric power supplied to the coil l*a*.

The changeover switch 8, a diode 9, a switch 14 and a controller 13 for controlling the amount of energization are serially connected to a battery 10. A point intermediate the diode 9 and changeover switch 8, and a point intermediate the energization controller 13 and the switch 14, are connected by a series circuit composed of a controller 12, which is for controlling an amount of charging, and a capacitor 11.

The charging controller 12 and energization controller 13 are both for variably controlling the amount of energization in dependence upon the value of engine rpm and the size of the engine load in response to signals from a control unit 15.

The changeover switch 8, switch 14, energization controller 13 and charging controller 12 are connected to the control unit 15. Applied as inputs to the control unit 15 are an output signal from a timing sensor 16 for sensing crank angle, namely the rotational phase of the engine, and output signal from a rotation sensor 17 which senses engine rpm, and an output signal from a load sensor 18 which senses engine load from the amount of fuel supplied to the engine.

The control unit 15 includes, in addition to an input-/output interface for supervising input/output of the aforementioned signals, a ROM in which a program and data are stored in advance, a CPU which performs processing under the control of the program stored in the ROM, a RAM for temporarily storing input signals and results of processing, and a control memory for controlling the flow of signals within the control unit 15.

The operation of the apparatus according to the invention will now be described.

Figure 2:
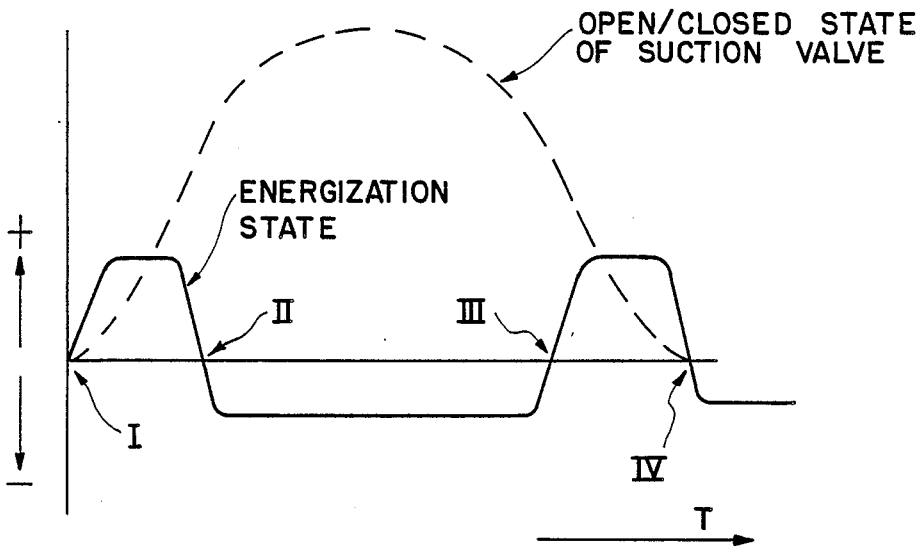
FIG. 2 is a view showing the direction in which a current is passed through a coil.

FIG. 2 is a view showing the relationship between the direction in which energizing current is passed through the coil 1*a* and time elapsed from the moment at which the suction valve 4 is opened. In FIG. 2, elapsed time T is plotted along the horizontal axis and the direction of the energizing current is plotted along the vertical axis. The + direction, which is that along the vertical axis above the horizontal axis, is the direction of a current which will produce an electromagnetic force in a direction to open the suction valve 4, while the - direction, which is that along the vertical axis below the horizontal axis, is the direction of a current which will produce an electromagnetic force in a direction to close the suction valve 4. The curve indicated by the broken line corresponds to a so-called "cam profile curve" and indicates the open/closed state of the suction valve 4.

Prior to the moment at which the suction valve 4 begins operating, the switch 14 is closed and current is passed into the coil 1*a* in one direction, namely in a direction which will produce the N pole at the internal magnetic pole 1*b* and the S pole at the external magnetic pole 1*c*, via the changeover switch 8. As a result, an attractive force acts between the electromagnet 1 and the permanent magnet 2.

The amount of energization is controlled by the controller 13. Accordingly, the electromagnetic force generated by the electromagnet 1 attains a prescribed strength. In concurrence with the above-described energization of the coil, electric power from a battery 10 charges the capacitor 11. The amount of charging is controlled by the controller 12. When it attains a prescribed amount, charging of the capacitor 11 ceases.

When the crank angle sensed by the timing sensor 16 coincides with the timing at which the suction valve 4 begins operating, namely that at which the valve is opened, as obtained from the output signals of the rotation sensor 17 and load sensor 18, the control unit 15 outputs a signal to change over the changeover switch 8 so that the energizing current flowing through the coil 1*a* is reversed and caused to flow in the + direction. Also, the limitation on the current applied by the energization controller 13 is removed and a resistance-less state is established. The switch 14 is opened immediately after this change in state is made.

When this is done, the charge that has accumulated in the capacitor 11 flows into the coil 1*a*. Though the energization controller 12 applies a current limitation in the charging direction, it does not do so in the discharging direction. In addition, the capacitor has a low internal resistance. Consequently, the discharge takes place instantaneously. Since a large current therefore flows into the coil 1*a*, the electromagnet 1 applies a strong repulsive force to the permanent magnet 2.

At a time II at which a first set time period elapses from a time I at which the suction valve 4 opens, the control unit 15 changes over the changeover switch 8 to return the energizing current flow to the − direction, and closes the switch 14.

Since an attractive force acts between the electromagnet and the permananet magnet 2 by virtue of the foregoing operation, the speed at which the suction valve 4 moves in the opening direction is reduced and the valve is stopped. When the action of the attractive force is continued even after the suction valve stops, the valve starts to move in the closing direction. Though the amount of energization is controlled by the controller 13, it is unnecessary for the amount of energization to be made the same as that which prevailed during the time the valve was kept closed prior to time I.

The capacitor 11 is charged just as described above also when the current is flowing in the direction − direction after time II.

At a time III at which a second set time period elapses from time II, the control unit 15 changes over the changeover switch 8 again so that the energizing current is made to flow in the +direction, and the switch 14 is opened so that a current will flow into the coil 1*a* from the capacitor 11, thereby applying a repulsive force to the permanent magnet 2. As a result of this operation, the speed of the suction valve 4 in the closing direction is reduced.

At a time IV at which a third set time period elapses from time III, namely at a moment just before the suction valve 4 is seated, a change is made to an energizing state similar to that which prevailed when the suction valve 4 was being held closed prior to time I, and the valve is held in the closed state until the next timing at which the valve is opened.

The first, second and third set time periods mentioned above are obtained by storing a table, which gives the relationship between each set time and engine rpm and load, in the ROM in advance, and computing the time periods from engine rpm sensed by the rotation sensor 17 and the engine load sensed by the load sensor 18.

A map giving the relationship between engine rpm and valve opening timing is stored in the ROM in advance, and valve opening timing is altered with a change in engine rpm, whereby engine output and efficiency can be raised over the entire region of engine rpm.

In a case where an engine is composed of a plurality of cylinders, it is possible to perform cylinder control to increase or decrease the number of operating cylinders by driving or stopping the suction/exhaust valves of each valve attendant upon a rise or fall in engine rpm.

Though an embodiment of the present invention has been described primarily with regard to a suction valve, it is obvious that the drive apparatus according to the invention can be similarly applied to an exhaust valve.

As many apparently widely different embodiments of the present invention can be made without departing from the spirit and scope thereof, it is to be understood that the invention is not limited to the specific embodiments thereof except as defined in the appended claims.

What is claimed is:

1. An electromagnetic force valve driving apparatus for opening and closing a poppet valve of an engine, comprising:

a movable permanent magnet connected to an axial end portion of said valve;

a fixed electromagnet having magnetic poles opposing magnetic poles of said movable permanent magnet;

valve timing calculating means for detecting rotational speed and load of said engine and determining valve opening and closing time corresponding to the rotational speed and load;

valve control means for energizing said fixed electromagnet and controlling the opening and closing of said valve in accordance with the opening and closing timing determined by said timing calculating means;

charge accumulating means for storing up a charge which energizes said fixed electromagnet; and charging control means for increasing and decreasing the amount of charging of said charge accumulating means in proportion to engine rpm.

2. The driving apparatus according to claim 1, wherein said charge accumulating means comprises a capacitor.

3. The driving apparatus according to claim 1, wherein said movable permanent magnet is annular in shape.

4. The driving apparatus according to claim 1, wherein a pair of magnetic poles of said fixed electromagnet oppose respective ones of N and S poles of the movable permanent magnet.

5. The driving apparatus according to claim 1, wherein said valve comprises a ceramic.

* * * * *